United States Patent [19]

Tsumaki et al.

[11] Patent Number: 4,916,404

[45] Date of Patent: Apr. 10, 1990

[54] ELECTRON STORAGE RING

[75] Inventors: Koji Tsumaki, Kodaira; Masatsugu Nishi, Katsuta; Masashi Kitamura, Hitachi; Jyoji Nakata, Kawasaki; Masayuki Nakajima, Zama, all of Japan

[73] Assignees: Hitachi, Ltd.; Nippon Telegraph and Telephone Corporation, both of Tokyo, Japan

[21] Appl. No.: 211,265

[22] Filed: Jun. 24, 1988

[30] Foreign Application Priority Data

Jun. 24, 1987 [JP] Japan ..... 62-155488

[51] Int. Cl.[4] ..... H05H 7/00

[52] U.S. Cl. ..... 328/233; 328/230; 335/216

[58] Field of Search ..... 328/228–230, 328/233–235; 335/216; 313/62

[56] References Cited

U.S. PATENT DOCUMENTS 4,123,720 10/1978 Rosander et al. ..... 328/234

FOREIGN PATENT DOCUMENTS 193837 9/1986 European Pat. Off. .
2165988 4/1986 United Kingdom .

OTHER PUBLICATIONS

Design Report on Deflecting Magnets in the Radiation Ring Photon Factory in Laboratory of High Energy Physics, (Jun. 6, 1979).

*Primary Examiner*—Donald J. Yusko
*Assistant Examiner*—Michael Horabik
*Attorney, Agent, or Firm*—Antonelli, Terry & Wands

[57] ABSTRACT

A pair of iron magnetic poles are disposed at the exit of electrons of each of deflecting magnets in an electron storage ring, in which electrons are stored during a certain period of time while being rotated therein, for generating a magnetic field in the direction opposite to that generated by the deflecting magnets. The magnetic field generated by these iron magnetic poles compensates deviations of the orbit of electrons due to the magnetic fringe field of each of the deflecting magnets.

11 Claims, 9 Drawing Sheets

ELECTRON STORAGE RING

BACKGROUND INVENTION

This invention relates to an electron storage ring in a synchrotron radiation apparatus and in particular to an electron storage ring having deflecting magnets, which are suitable for reducing deviations of the orbit of particles.

Prior art deflecting magnets were normally conductive magnets and the magnetic fringe field gave rise to no particular problem. Therefore no special measure was taken for decreasing the magnetic fringe field. It was tried only to make the magnetic fringe field uniform in the radial direction perpendicular to the orbit by using shims. For literature on the normally conductive magnet there is a design report on deflecting magnets in the radiation ring photon factory in Laboratory of High Energy Physics in Japan (published June 6, 1979).

SUMMARY OF THE INVENTION

An object of this invention is to provide means for reducing deviations of a closed orbit due to the magnetic fringe field.

Another object of this invention is to provide means for keeping deviations of the closed orbit due to the magnetic fringe field below several mm.

In order to achieve the above objects according to this invention the following construction is adopted.

In an electron storage ring consisting of a high frequency cavity for accelerating electrons, focusing magnets for focusing an electron beam, defocusing magnets for defocusing electrons, a superhigh vacuum chamber for storing electrons, and deflecting magnets having iron cores for reducing magnetomotive force and superconductive coils for generating magnetic field, there are disposed a pair of iron magnetic poles for each magnet, an end of each of which is connected with one of the iron cores and the other ends of which are located symmetrically to each other with respect to the orbit plane, so as to surround the superconductive coils.

That is, according to this invention, by adding a pair of new iron magnetic poles surrounding the coils thereto a part of the magnetic flux in the iron cores is led to these new magnetic poles. At the new magnetic pole portion, is produced a magnetic field in the direction opposite to that of the deflecting magnet. The magnetic fringe field is shielded by the new magnetic poles so that the magnetic field in the same direction as that of the deflecting magnet disappears outside of the new magnetic poles.

According to this invention, since the orbit of electrons is bent outward by the magnetic field in the direction opposite to that of the deflecting magnet, the effect of the magnetic fringe field, by which it is bent inward, is compensated by the effect, by which it is bent outward. For this reason the orbit becomes parallel to the ideal orbit at the entrance of the deflecting magnet and deviations of the orbit are also smaller there. Consequently an effect can be obtained that deviations of the closed orbit are so small also within the deflecting magnet that they can be kept below several mm.

DESCRIPTION OF THE PREFERRED EMBODIMENTS

At first, in order to facilitate understanding of this invention, several problems of the prior art techniques will be explained, referring to figures.

In an electron storage ring and in particular in an electron storage ring for generating radiation, electrons should be continuously conserved in a period of time as long as about 10 hours. For this reason it is required for magnets for forming an electron orbit and in particular deflecting magnets for deflecting electrons to have a high uniformity in the magnetic field intensity. The width of the region, as measured from the design electron orbit, where this high uniformity in the magnetic field intensity is represented by;

$$\pm(7\alpha+\text{C.O.D.})\ldots \quad (1)$$

where $\alpha$ is a standard deviation, when it is supposed that an electron beam has a Gaussian distribution in its cross-section, and C.O.D. represents deviations of the electron beam from the design orbit therefor.

Figure 2:
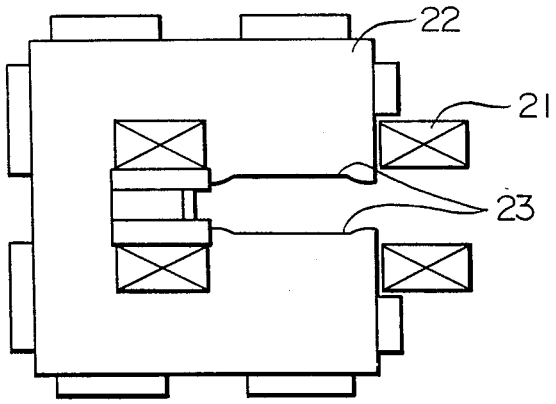
FIG. 2 PRIOR ART
FIG. 2 is a side view of a normally conductive magnet.

The uniform magnetic field region, in which this high uniformity in the magnetic field intensity is required, can be relatively easily obtained for a normally conductive magnet. Since the magnetic field intensity of the normally conductive magnet is low, the iron core 22 in FIG. 2 is not saturated. For this reason the magnetic field distribution is almost determined by the shape of the iron magnetic pole 23 and thus a large uniform magnetic field region is obtained by forming the iron magnetic poles as indicated in FIG. 2. On the other hand, for a superconductive magnet, the magnetic field distribution is determined by the shape of the magnetic pole, when the magnetic field intensity is low, and by the arrangement of the coil 21, when the magnetic field intensity is high, because the iron core is saturated. When the magnetic field intensity is about 1.7 T, a part of the iron is saturated and the other part is unsaturated. For this reason it is difficult to obtain a so large uniform magnetic field region as that obtained by the normally conductive magnet for a wide domain extending from low to high magnetic field intensities. Therefore, for the superconductive magnet, it is necessary to maintain C.O.D. representing deviations of the orbit in Eq. (1) to be as small as possible.

Figure 3A:
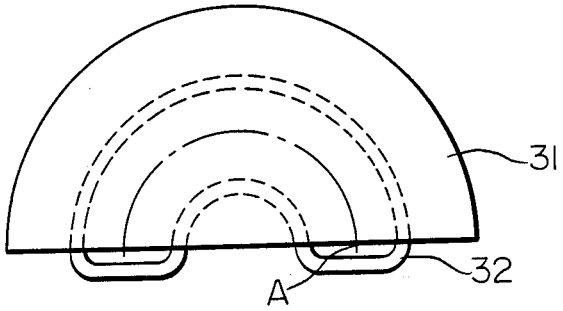
FIG. 3A PRIOR ART
FIG. 3A is a plan view of a deflecting magnet.
Figure 3B:
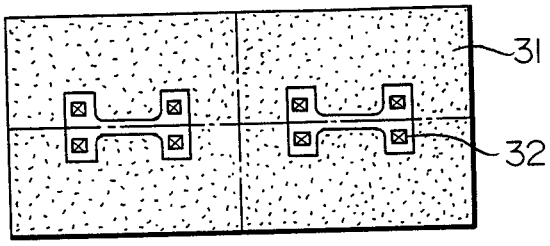
FIG. 3B is a front view of the deflecting magnet.
Figure 4:
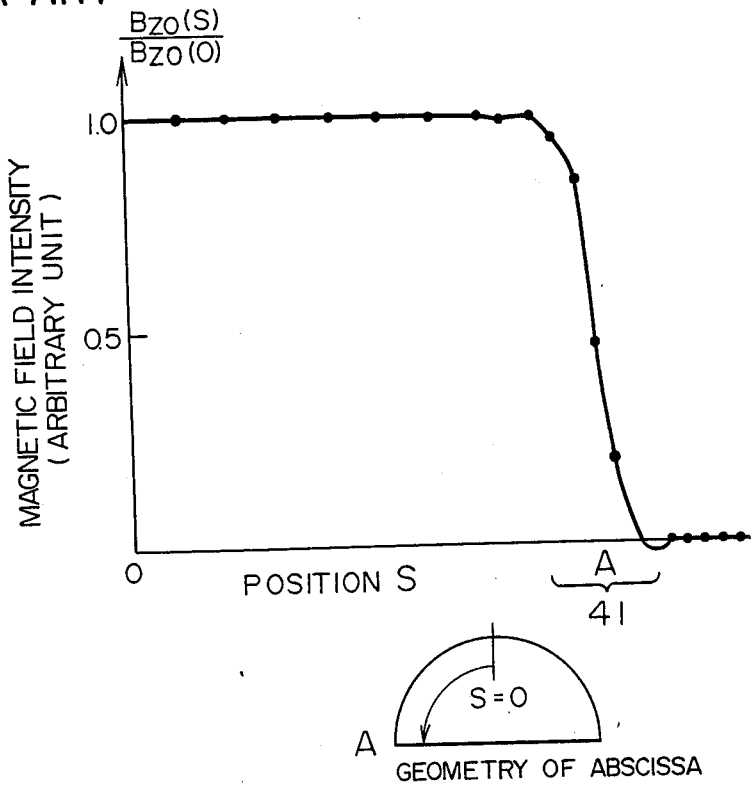
FIG. 4 PRIOR ART
FIG. 4 is a graph showing a magnetic field intensity distribution along the orbit of the deflecting magnet.
Figure 5A:
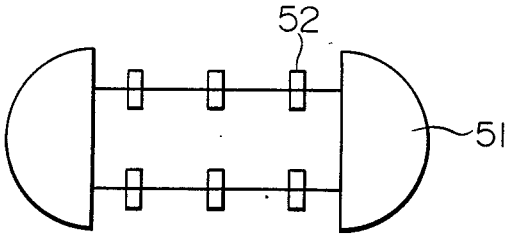
FIG. 5A PRIOR ART
FIG. 5A is a scheme illustrating an electron storage ring, for which the deflecting magnet is divided into 2.
Figure 5B:
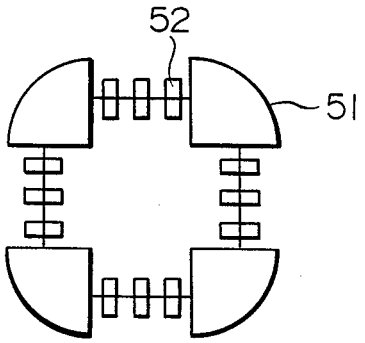
FIG. 5B is a scheme illustrating another electron storage ring, for which the deflecting magnet is divided into 4.
Figure 5C:
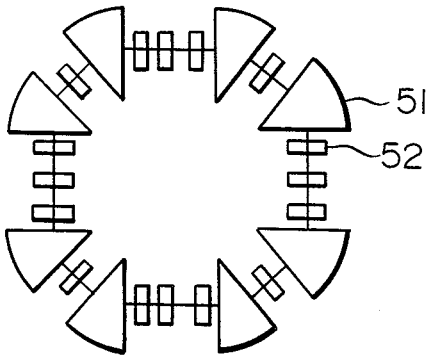
FIG. 5C is a scheme illustrating still another electron storage ring, for which the deflecting magnet is divided into 8.
Figure 6A:
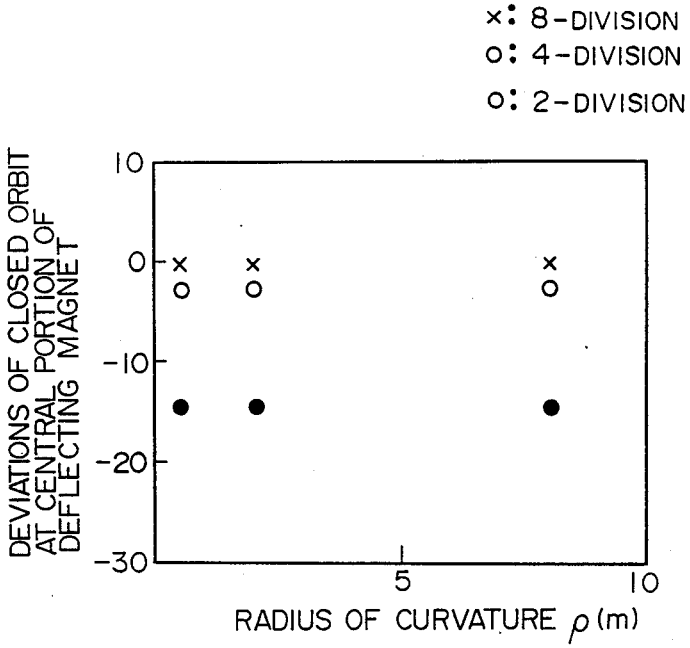
FIG. 6A PRIOR ART
FIG. 6A is a diagram showing deviations of a closed orbit at the central portion of a deflecting magnet.
Figure 6B:
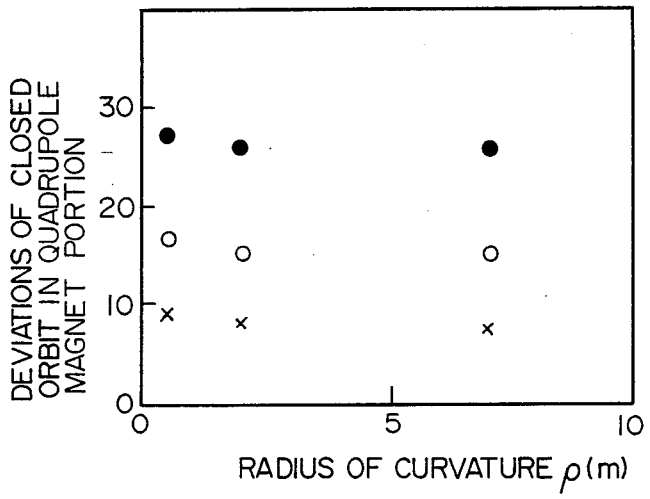
FIG. 6B is a diagram showing deviations of the closed orbit at the exit of a quadrupole magnet.

FIGS. 3A and 3B illustrate a superconductive 180° deflecting magnet. In the figures reference numeral 31 represents an iron core and 32 indicates a coil. FIG. 4 shows calculation results of the magnetic field distribution along the orbit of this magnet by using a 3-dimensional magnetic field program. In the FIG. A represents the end of the magnet. As indicated in FIG. 4, the magnetic field distribution is not reduced to zero at the end A of the magnet, but it has a slowly decreasing tail along the orbit. In the case where there is a magnetic fringe field 41 as indicated in FIG. 4, when the deflection angle of a deflecting magnet is 180° (divided into 2) 90° (divided into 4) and 45° (divided into 8), as indicated in FIGS. 5A, 5B and 5C, respectively, deviations of the closed orbit are calculated by using the radius of curvature as a parameter and results thus obtained are indicated in FIGS. 6A and 6B. Here the closed orbit means the electron orbit, when the oscillation called betatron oscillation of electrons is 0. Usually electrons rotate along this closed orbit in the ring, while being subjected to betatron oscillation around it. As clearly seen from FIGS. 6A and 6B, the deviations of the closed orbit don't depend strongly on the radius of curvature of the deflecting magnet 51, but they decrease with increasing number, into which the deflecting magnet 51 is divided. The deflection angle per one deflecting magnet in a prior art electron storage ring was as small as about 10° to about 45°. Consequently the number of division of the magnet was great and the deviations of the orbit in the deflecting magnet were small. Further, since a large homogeneous magnetic field region was obtained owing to the fact that it was a normally conductive magnet, the problem on the deviations of the orbit due to the magnetic fringe field was not so severe.

Figure 7:
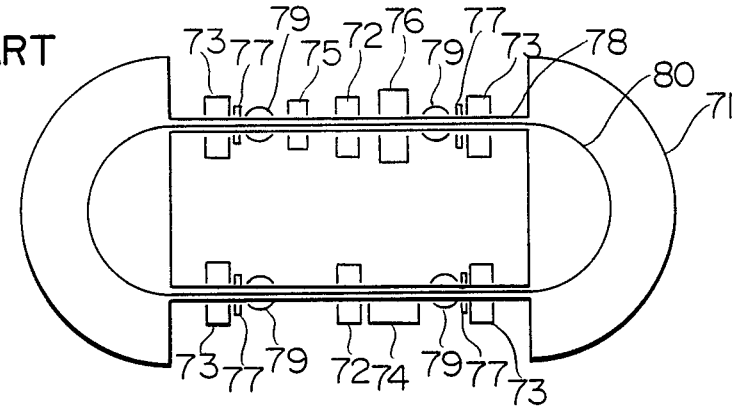
FIG. 7 PRIOR ART
FIG. 7 is a scheme illustrating an electron storage ring.

However, in order to reduce the size of the electron storage ring and to make it more compact, while maintaining the high energy thereof as it is, it is advantageous to use superconductive magnets and to reduce the number of division of the deflecting magnet as far as possible. In the case where the deflecting magnet is not divided, there is a drawback that the focusing effect on the electron beam is weak and that it is not possible to alter the property of the electron beam. For this reason the smallest and most compact electron storage ring as indicated in FIG. 7 can be obtained by dividing the deflecting magnet into 2 and by disposing focusing magnets 72 therebetween. However, in this case, deviations of the orbit in the deflecting magnet 71 are great, as described previously. For this reason the homogeneous magnetic field region given by Eq. (1) must be large and thus there is a problem that it is difficult to obtain a large homogeneous magnetic field region because of superconductive magnets.

Figure 8A:
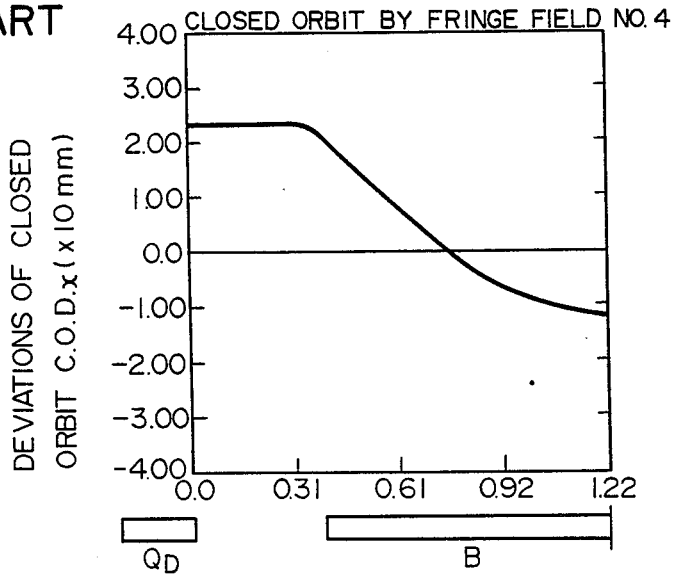
FIG. 8A PRIOR ART
FIG. 8A is a graph showing deviations of a closed orbit in an electron storage ring indicated in FIG. 8B.
Figure 8B:
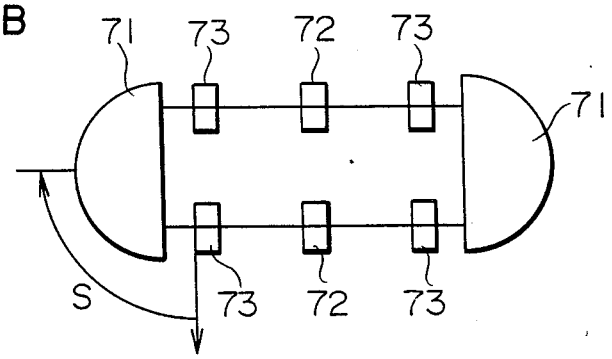
FIG. 8B is a scheme illustrating the electron storage ring.

FIG. 8A shows deviations of the closed orbit in a deflecting magnet having a magnetic field intensity of 3.5 T, a radius of curvature of 0.5 m and the magnetic fringe field indicated in FIG. 4. The abscissa represents S in FIG. 8B. In this case the deviation of the closed orbit in the deflecting magnet 71 is greater than 1 cm and the required homogeneous magnetic field region should be about ±20 mm. It is difficult to assure such a large homogeneous magnetic field over a wide range extending from low to high magnetic fields. However it seems that although it is difficult to realize a homogeneous magnetic field region as wide as ±15 mm, it is not impossible. Therefore, the width of the homogeneous magnetic field region being ±15 mm, the beam size being 1 mm, the deviations of the closed orbit due to the other factors being 5 mm, C.O.D.F., which represents deviations of the closed orbit due to the magnetic fringe field can be given by;

$$15>(7\alpha+5+C.O.D.F.)=12+C.O.D.F. \quad (2)$$

That is, C.O.D.F.<3 mm. Consequently it is necessary to maintain deviations of the orbit due to the magnetic fringe field to a value smaller than that described above.

Figure 1A:
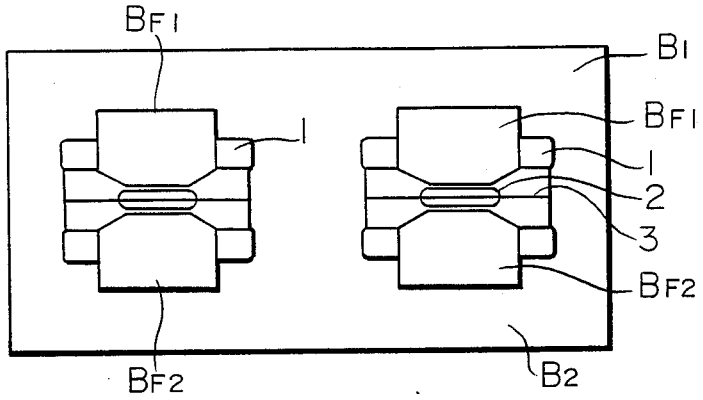
FIG. 1A is a front view of a deflecting magnet.
Figure 1B:
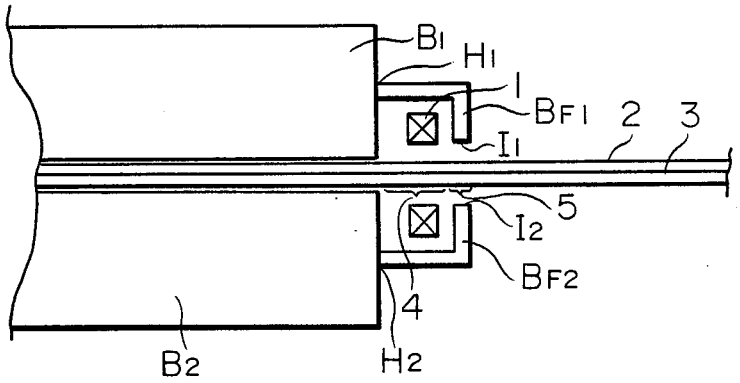
FIG. 1B is a side view of the deflecting magnet.

As indicated in FIG. 8A, the closed orbit passes on the outer side of the central orbit at the exit of a quadrupole magnet. It begins to bend inward gradually because of the magnetic fringe field and passes on the inner side of the central orbit within the deflecting magnet. The reason why the orbit is deviated so widely is that the magnetic fringe field has a long tail extending to the quadrupole magnet. Consequently, in order to reduce the deviations of the closed orbit, the tail of the magnetic fringe field should be shortened and at the same time the orbit should be bent outward in advance by an amount, by which it is bent inward by the magnetic fringe field. For this purpose a pair of new iron magnetic poles may be so disposed that it surrounds the coil, as indicated in FIG. 1B. In this way no magnetic flux leaks outside of this pair of new magnetic poles and a magnetic field in the direction opposite to that of the deflecting magnet is produced at the new magnetic pole portion so as to compensate deviations of the orbit.

Figure 9:
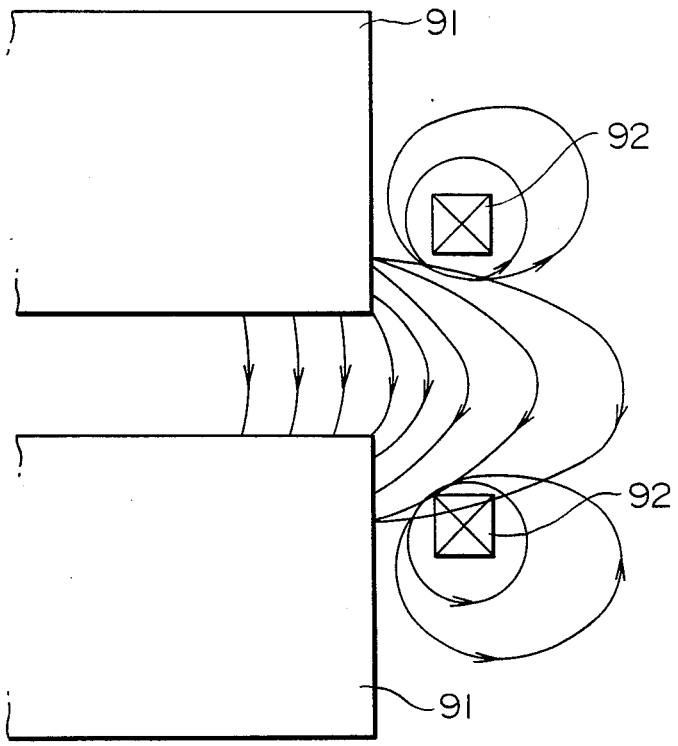
FIG. 9 PRIOR ART
FIG. 9 indicates schematically the magnetic fringe field of a prior art magnet.

FIG. 9 shows schematically magnetic lines of force at the fringe portion and thus the magnetic fringe field has far reaching influences. In the figure reference numeral 91 represents the iron core and 92 the coil.

Figure 10:
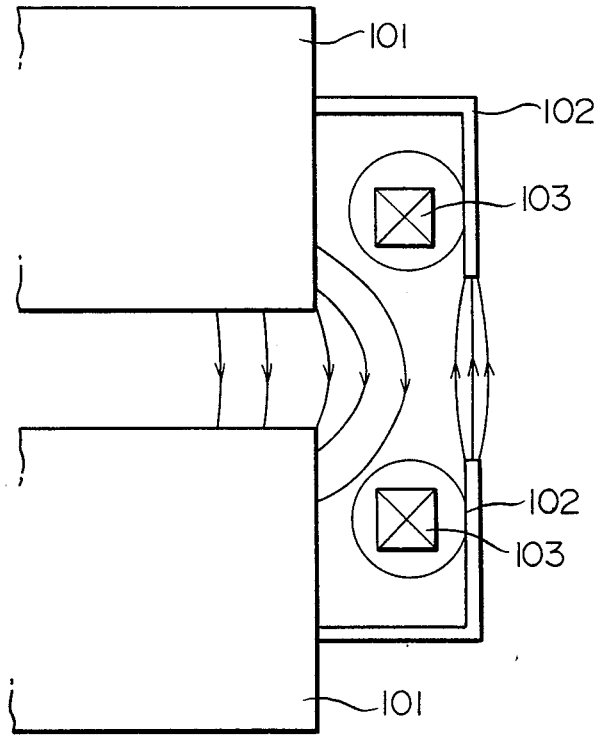
FIG. 10 indicates schematically the magnetic fringe field in the case where a pair of new iron magnetic poles are added thereto.

According to this invention a part of the magnetic flux in the iron core is led to a pair of new magnetic poles additionally provided so as to surround the coils. A magnetic field in the direction opposite to that of the deflecting magnet is produced at the new magnetic pole portion. The magnetic fringe field is shielded by the new magnetic poles so that the magnetic field in the same direction as that of the deflecting magnet disappears outside of the pair of new magnetic poles. FIG. 10 shows the magnetic field distribution in this case. In the figure reference numeral 101 represents an iron core, 102 a new iron magnetic pole, and 103 a superconductive coil. When an electron enters such a magnetic field distribution, it flies straightly, because there is no magnetic field outside of the pair of new magnetic poles. The electron is bent outward at the new magnetic pole portion and inward by the magnetic fringe field between the pair of new magnetic poles and the end of the magnet. Therefore the orbit of the electron is almost perpendicular to the end surface of the body of the deflecting magnet and it is not deviated. In this way deviations of the closed orbit in the deflecting magnet are naturally reduced.

[Embodiment 1]

Hereinbelow an embodiment of this invention will be explained. At first the whole construction of the electron storage ring will be explained. As indicated in FIG. 7, the electron storage ring consists of deflecting magnets 71 deflecting the electron beam; focusing magnets 72 and defocusing magnets 73 for focusing it; an inflector 74 for inflecting electrons coming from an injector so as to introduce them in the electron storage ring; a perturbator 75 for shifting the orbit at this time; a high frequency accelerating cavity 76 for accelerating electrons; a beam position monitor 77 for monitoring the position of the electron beam and vacuum pumps 79 for exhausting the vacuum chamber of the ring to a high vacuum.

The electron beam rotates in this storage ring, while repeating oscillation called betatron oscillation around a closed orbit. This orbit is called a closed orbit. If the deflecting magnets and the focusing magnets were ideally fabricated and mounted without mounting errors, the closed orbit of electrons would be the orbit 80 indicated by a full line in FIG. 7. However, when there exists irregular magnetic fields such as fringe fields, electrons are deviated from the closed orbit and follow an orbit other than that indicated by the full line.

Figure 11:
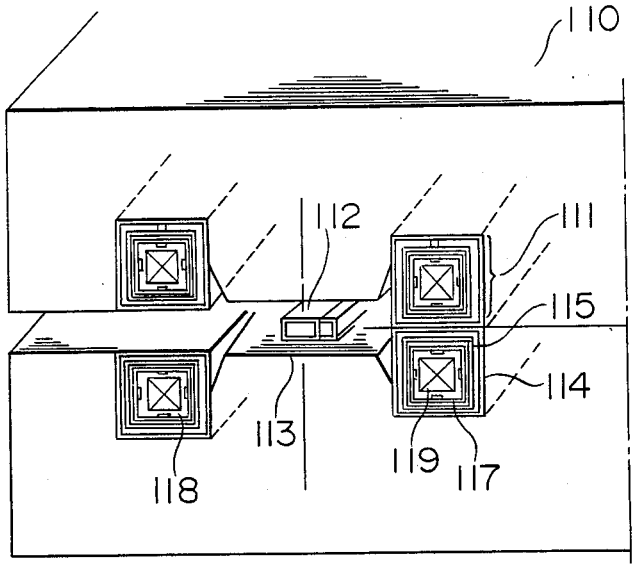
FIG. 11 is a front view of a superconductive deflecting magnet.

Now the deflecting magnet portion producing this magnetic fringe field is explained (refer to FIG. 11). The deflecting magnet portion consists of a pair of iron cores 110 reducing the magnetomotive force of the coil, a coil portion 111 generating the magnetic field, a vacuum chamber 112 maintaining a superhigh vacuum state and storing an electron beam, and a pair of magnetic poles 113 generating a magnetic field distribution perpendicular to the plane of the beam orbit in the vacuum chamber. The pair of iron cores described above determine the distribution of the magnetic field, when the magnetic field intensity is still low before the saturation of the iron cores.

The coil portion consists of a heat insulating vacuum chamber portion 114, a thermal shield 115, a heat insulating support (not shown), a helium vessel 117, in which liquid helium is put, liquid helium 118 in the helium vessel 117, and a superconductive coil 119 submerged in the liquid helium. According to this invention, as indicated in FIG. 1, new iron cores BF1 and BF2 are added to the upper and lower iron cores B1 and B2 of this deflecting magnet, respectively. Each of the two new iron magnetic poles BF1 and BF2 is jointed to one of the iron cores of the deflecting magnet at one end $H_1$, $H_2$ and the other ends $I_1$ and $I_2$ are so positioned that they are symmetric with respect to the orbit plane. These new iron magnetic poles BF1 and BF2 produce a magnetic field on the orbit plane.

Figure 12:
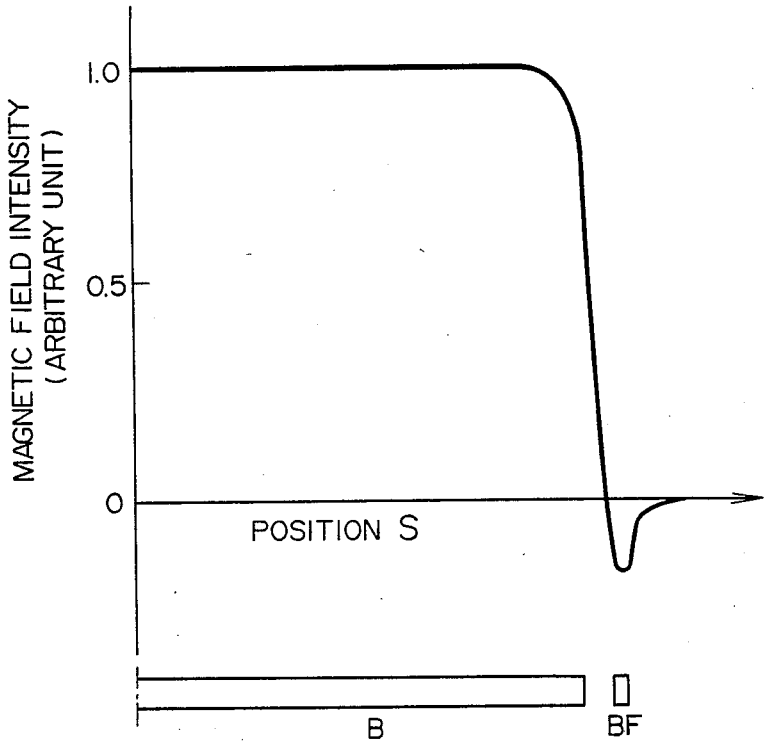
FIG. 12 indicates a magnetic field intensity distribution in the case where a pair of new iron magnetic poles are added thereto.

When electric current flows through the superconductive coil 1, magnetic field is produced not only on the orbit plane 3 within the deflecting magnet but also at the portion 4 where they are no iron cores and at the new magnetic pole portion 5, which is newly added. The magnetic fringe field produced at the portion where there are no iron cores exists still inside of the new iron magnetic poles $I_1$ and $I_2$, but it is restricted by the new magnetic poles from extending outside of the area defined by the new iron magnetic poles. At the new magnetic pole portion, since a part of the flux passes through the new iron magnetic poles, a magnetic field in the direction opposite to that of the deflecting magnet is produced. FIG. 12 shows results obtained by calculating the magnetic field distribution in such a system by means of a 3-dimensional magnetic field calculating program.

When a magnetic fringe field is produced, the closed orbit is shifted. However, since only electrons, which are in synchronism with the accelerating high frequency, rotate in the storage ring, the length of the closed orbit making one turn in the ring is kept always constant and doesn't depend on the magnetic fringe field. Consequently the shift of the closed orbit should be obtained under the condition that the length of the closed orbit remains unchanged, even if the magnetic fringe field exists. Furthermore attention should be paid to the fact that the energy of electrons is given by;

$$E = \frac{BS}{BS_o} E_o, \tag{3}$$

where BS represents the integral value of the magnetic field along the closed orbit; $BS_o$ that obtained in the case where there exists no magnetic fringe field; and $E_o$ the energy of electrons in the case where there exists no magnetic fringe field.

Using Eq. (1), if there exists a magnetic fringe field, $BS > BS_o$ and therefore the energy of electrons increases. Since the magnetic field intensity remains unchanged and the energy increases, the radius of curvature becomes greater than the initial one.

Figure 13:
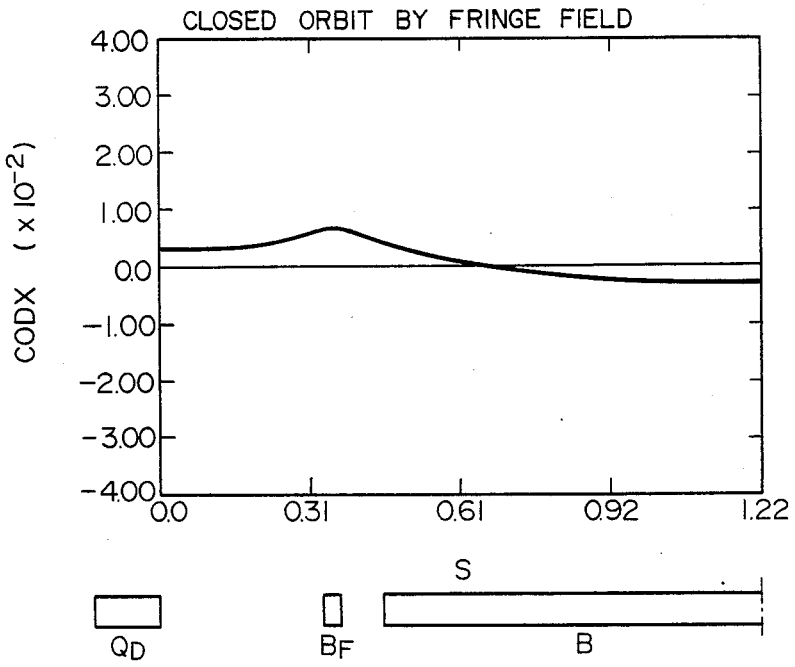
FIG. 13 is a graph showing deviations of the closed orbit in the case where the pair of new iron magnetic poles are added.

FIG. 13 indicates results obtained by calculating deviations of the closed orbit, taking the fact described above into account, in the case where there exists the magnetic fringe field indicated in FIG. 12. In FIG. 13 the origin of the coordinate axes is the position of the exit of the quadrupole magnet and the abscissa represents the distance measured from the origin along the orbit, the end of the abscissa being the center of the deflecting magnet. From this figure it can be understood that the orbit is shifted outward by 3 mm at the exit of the magnet and in the new iron magnetic pole the orbit is shifted further outward because of the magnetic field in the direction opposite to that of the deflecting magnet. After having passed through the new iron magnetic pole portion BF, the orbit is bent slowly inward due to the magnetic fringe field and on the contrary in the deflecting magnet it is shifted inward by about 3 mm.

As explained above, it can be understood that it is possible to suppress the shift of the closed orbit, which is greater than 10 mm without new magnetic poles, below several mm by disposing them.

[Embodiment 2]

Figure 14:
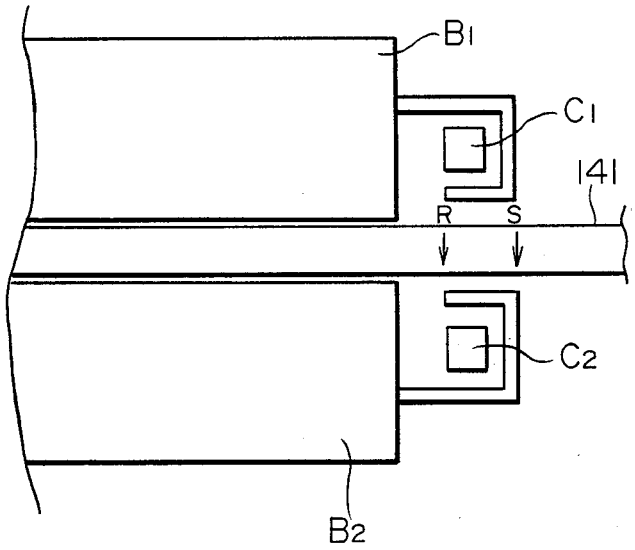
FIG. 14 indicates a structure of the pair of new iron magnetic poles, in which one end of each thereof is bent so that a greater part thereof surrounds a coil.

As indicated in FIG. 14, the parts of the two coils $C_1$ and $C_2$, which are outside of the iron magnetic pole of the deflecting magnet, are bent upward for the upper portion $C_1$ and downward for the lower portion $C_2$ so that there exist gaps between the coils $C_1$, $C_2$ and the vacuum chamber 141. The new iron magnetic poles are extended in these gaps so that each of them has a channel-shape. In this way the magnetic fringe field exists only inside of the point R and thus the region, where the magnetic fringe field exists, are narrowed. Between the points R and S of the new magnetic poles the magnetic field has the direction opposite to that of the deflecting magnet and plays the role to bend the orbit outward.

[Embodiment 3]

Figure 15:
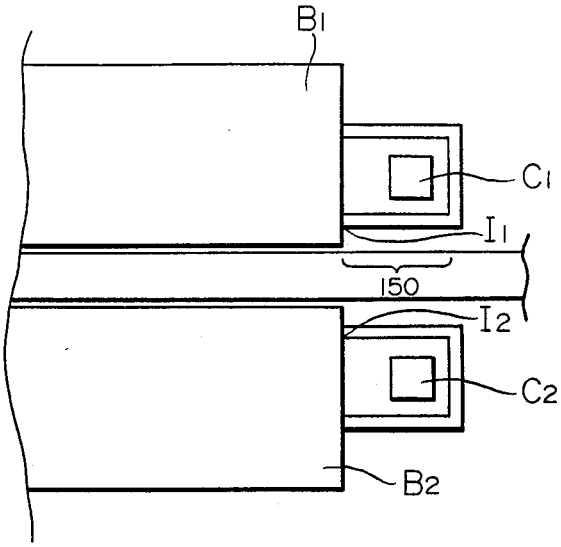
FIG. 15 indicates another structure of the pair of new iron magnetic poles, in which each of them encloses completely one of the coils.

The free ends $I_1$ and $I_2$ of the new magnetic poles disposed around the coils, respectively, in Embodiment 2 are extended to the iron cores of the deflecting magnet and jointed therewith, as indicated in FIG. 15. In this case the cross-section of each of the new iron magnetic poles is channel- or U-shaped. In this case the region of the magnetic fringe field is further narrowed and the new magnetic field portion 150, where the magnetic field having the direction opposite to that of the deflecting magnet, is enlarged.

[Embodiment 4]

Figure 16A:
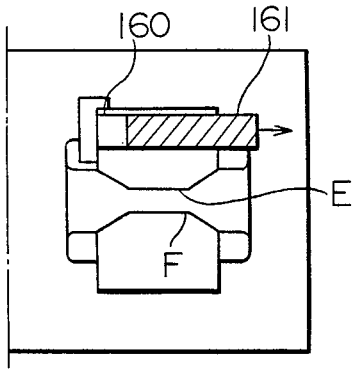
FIG. 16A is a front view of a deflecting magnet, in which a part of each of the new iron magnetic poles is movable so that the magnetic path can be regulated.
Figure 16B:
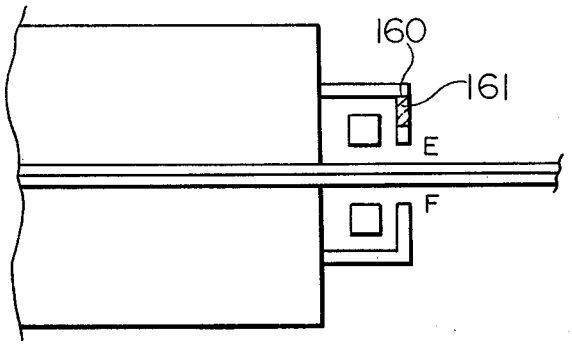
FIG. 16B is a side view of the deflecting magnet indicated in FIG. 16A.

As indicated in FIGS. 16A and 16B, there is disposed a sliding mechanism 160 for the new iron magnetic poles, a part 161 of each of the new iron magnetic poles being movable. The magnetic path in the iron core can be regulated by moving this movable part to left and right. In this case, since it is possible to vary the magnetic field intensity between the magnetic poles E and F, the ratio of the curvature, with which the orbit is bent inward, can be varied. In this way deviations of the closed orbit can be regulated by means of this magnetic path regulating mechanism.

We claim:

1. An electron storage ring comprising:

a high frequency cavity for accelerating electrons;

at least one focusing magnet for focusing an electron beam;

at least one defocusing magnet for defocusing an electron beam;

a superhigh vacuum chamber for storing electrons;

at least one deflecting magnet having an iron core for reducing magnetomotive force and superconductive coil means for generating a magnetic field, said iron core having upper and lower core portions between which an orbit plane of the electron beam extends; and a pair of iron magnetic poles coupled to said deflecting magnet, each of said magnetic poles extending between first and second ends thereof, the respective first ends of said magnetic poles being jointed with said upper and lower core portions of said iron core of said deflecting magnet, respectively, and the respective second ends of said magnetic poles being located symmetrically to each other with respect to the orbit plane, so as to surround the superconductive coil means.

2. An electron storage ring according to claim 1, wherein the cross-section of said iron magnetic poles is L-shaped in the longitudinal direction of the orbit of said electron beam.

3. An electron storage ring according to claim 1, wherein the cross-section of said iron magnetic poles in U-shaped with two legs extending in the longitudinal direction of the orbit of said electron beam.

4. An electron storage ring according to claim 3, wherein the respective second ends of said iron magnetic poles is jointed with said upper and lower core portions of said iron core of said deflecting magnet, respectively.

5. An electron storage ring according to claim 1, wherein a part of each of said iron magnetic poles is mounted movably so that the magnetic path can be regulated.

6. An electron storage ring comprising:

a high frequency cavity for accelerating electrons;

a superhigh vacuum chamber for storing electrons;

deflecting magnets having each an iron core for reducing magnetomotive force and superconductive coil means for generating a magnetic field, said iron core having two end portions between which an orbit of the electrons extend; and means disposed at the exit of electrons of each of said deflecting magnets for generating a magnetic field in the direction opposite to that generated by the associated deflecting magnet.

7. An electron storage ring according to claim 6, wherein said magnetic field generating means is composed of a pair of iron magnetic poles, each of said iron magnetic poles extending between a first and a second end thereof, the respective first ends being jointed with the two end portions of said iron core of the associated deflecting magnets, respectively, and the respective second ends being located symmetrically to each other with respect to the orbit plane, so as to surround said superconductive coil means of the associated deflecting magnet.

8. An electron storage ring according to claim 7, wherein the cross-section of each of said iron magnetic poles is L-shaped in the longitudinal direction of the orbit of said electron beam.

9. An electron storage ring according to claim 7, wherein the cross-section of each of said iron magnetic poles is U-shaped with two legs extending in the longitudinal direction of the orbit of said electron beam.

10. An electron storage ring according to claim 9, wherein the respective second ends of said iron magnetic poles is jointed with said two end portions of said iron core, respectively, of the associated deflecting magnet.

11. An electron storage ring according to claim 7, wherein a part of each of said iron magnetic poles is mounted movably so that the magnetic path can be regulated.

* * * * *